United States Patent [19]

Merger et al.

[11] 4,064,309

[45] Dec. 20, 1977

[54] PROCESS FOR PRINTING FIBROUS MATERIAL

[75] Inventors: Franz Merger, Frankenthal; Gerhard Nestler; Knut Oppenlaender, both of Ludwigshafen; Guenter Uhl, Worms; Ruediger Wissler, Weisenheim, all of Germany

[73] Assignee: BASF Aktiengesellschaft, Ludwigshafen, Germany

[21] Appl. No.: 736,893

[22] Filed: Oct. 29, 1976

[30] Foreign Application Priority Data

Dec. 12, 1975 Germany ..... 2555967

[51] Int. Cl.[2] ..... B05D 5/00; B05D 3/02; B32B 27/38

[52] U.S. Cl. ..... 428/413; 427/288; 427/385 B; 427/386; 427/389; 427/390 R; 427/390 A; 428/417

[58] Field of Search ..... 260/17 R, 17.4 ST, 29.6 RW; 427/288, 386, 390 A, 390 R, 385 B, 389; 428/515, 521, 413, 417

[56] References Cited

U.S. PATENT DOCUMENTS

| | | | |
|---|---|---|---|
| 2,696,168 | 12/1954 | Costello | 427/288 X |
| 3,694,241 | 9/1972 | Guthrie et al. | 427/288 |
| 3,928,688 | 12/1975 | Dachs et al. | 427/288 X |

*Primary Examiner*—Michael R. Lusignan
*Attorney, Agent, or Firm*—Keil, Thompson & Shurtleff

[57] ABSTRACT

A method of printing fibrous materials using a print paste incorporating as emulsifier a di-(α-phenylethyl)-phenol which has been first reacted with from 2 to 12 moles of propylene oxide and/or butylene oxide and then with from 14 to 30 moles of ethylene oxide.

4 Claims, No Drawings

PROCESS FOR PRINTING FIBROUS MATERIAL

U.S. Pat. No. 3,928,688 relates to a process for printing fibrous materials with print pastes which are based, in the conventional manner, on oil-in-water emulsions, organic pigments, thickeners, pigment binders and emulsifiers of the type of oxyalkylated phenol derivatives and to which are added, as the emulsifier, from 0.1 to 1.5% by weight, based on the finished print paste, of a di-(α-phenylethyl)phenol oxyethylated with from 12 to 16 moles of ethylene oxide.

The emulsifiers used in the process of said U.S. patent are mostly pasty at room temperature. These products must as a rule be melted before they are used. It is an object of the present invention so to improve the process of said patent that, whilst maintaining or improving the effectiveness of the process it is possible to start from emulsifiers which exhibit more advantageous viscosity characteristics. This latter term is to be understood to mean that the emulsifiers can be poured or pumped at room temperature, and are therefore easier to handle.

We have found that this object is achieved, in a process for printing fibrous materials with print pastes which are based, in the conventional manner, on oil-in-water emulsions, organic pigments, thickners, pigment binders and emulsifiers of the type of oxyalkylated phenol derivatives, and to which from 0.1 to 1.5% by weight, based on the finished print paste, of a di-(α-phenylethyl)-phenol oxyalkylated with from 12 to 16 moles of ethylene oxide has been added as the emulsifier, as described in U.S. Pat. No. 3,928,688, if the said emulsifier is replaced by an oxyalkylation product which is obtained by addition reaction of 1 mole of di-(α-phenylethyl)-phenol with from 2 to 13 moles of propylene oxide and/or butylene oxide, followed by reaction with from 14 to 30 moles of ethylene oxide.

The pastes on which the process of the invention is based consist in general of oil-in-water emulsions comprising water and a water-immiscible organic solvent or solvent mixture which boils at from 80° to 200° C. Examples of these solvents are hexanes, heptanes, nonanes, cyclohexylbenzenes, toluenes, xylenes and gasolines fractions boiling at from 80° to 200° C, or mixtures of these. Gasoline from a middle oil fraction is particularly suitable.

In addition to water and the stated solvents, the print pastes on which the process of the invention is based contain emulsion thickeners. These are in most cases water-soluble or water-swellable thickeners, eg. alignates, locust bean ethers, starch ethers or carboxymethylcellulose. Examples of particularly effective emulsion thickeners are synthetic thickeners disclosed in British Pat. No. 1,358,430 (incorporated herein by reference. These emulsion thickeners are derived from diurethanes and polyurethanes of polyetherdiols. They are described in detail in the said application and can also be used in the same proportions in the print pastes on which the process of the invention is based. Depending on the desired viscosity of the print paste, the latter contains from about 0.02 to 1 percent by weight, preferably from 0.05 to 0.5 percent by weight — based on the finished print paste — of the said thickeners.

According to the invention, print pastes which contain an oxyalkylation product of a particular structure as the emulsifier, are employed. This oxyalkylation product is manufactured by first reacting 1 mole of di-(α-phenylethyl)-phenol with from 2 to 12, preferably from 3 to 9, moles of propylene oxide, and then reacting the product with from 14 to 30, preferably from 15 to 25, moles of ethylene oxide per mole of the original di-(α-phenylethyl)-phenol. Instead of propylene oxide, butylene oxide or mixtures of propylene oxide and butylene oxide may be employed. The amount of butylene oxide used is as a rule from ;b 2 to 10 moles, preferably from 3 to 6 moles, per mole of di-(α-phenylethyl)-phenol. In a further variant, di-(α-phenylethyl)-phenol is subjected to addition reaction first with propylene oxide and then with butylene oxide, or vice versa. However, bright prints and stable print pastes are only obtained if the product of the reaction of di-α-phenylethyl)-phenol with butylene oxide and/or propylene oxide is subjected to addition reaction with from 14 to 30 moles of ethylene oxide. This result was surprising since products of similar structure which contain terminal propylene oxide blocks or butylene oxide blocks give substantially poorer prints and in some cases even cause phase separation of the oil-in-water emulsion. The emulsifiers to be employed according to the invention are used in amounts of from 0.1 to 1.5% by weight, based on the total print paste.

In addition, the print pastes generally contain the conventional binders for textile printing, such as are described in detail in, for example German Pat. No. 1,140,898 (incorporated herein by reference). The binder is preferably synthesized from monomers which give copolymers which are soft and elastic at room temperature, eg. vinyl esters of higher carboxylic acids, such as vinyl propionate, acrylic acid esters and methacrylic acid esters, such as methyl acrylate, ethyl acrylate or butyl acrylate, or butyl methacrylate, or butadiene and its homologs. These are polymerized either by themselves or as mixtures, or are copolymerized with yet further monomers, for example with maleic acid esters, fumaric acid esters, vinyl ethers, vinyl ketones, styrene, vinyl chloride, vinylidene chloride, vinyl acetate, acrylonitrile and methyl methacrylate. In addition, small amounts of water-soluble polymerizable compounds, eg. acrylic acid, vinylpyrrolidone, amides of unsaturated acids or the N-methylol compounds or N-methylol ethers of these amides, may be copolymerized. The polymers may also contain yet further comonomers which possess at least one polymerizable double bond, eg. esters of α, β-ethylenically unsaturated organic acids, such as acrylic acid or metacrylic acid, with alcohols which possess a halogen atom in the β-position to a free hydroxyl group, eg. 3,3-dichloro-propane-1,2-diol, 2,3-dichloro-butane-1,4-diol, 3-chlorobutane, 2,4-diol, 1,4-dichlorobutane-2,3-diol, 3-chloro-2-methylpropane-1,2-diol or 3-chloro-2-chloromethyl-propane-1,2-diol. The ratios in which these monomers and comonomers are mixed, and the percentage proportion in the print pastes, may be chosen in accordance with what is stated about these parameters in German Pat. No. 1,140,898.

The abovementioned solvents for the manufacture of the oil-in-water emulsion can furthermore contain from 0.01 to 0.15 percent by weight, based on the finished print pastes, of deforming agents, preferably defoaming agents specified, for example, in U.S. Pat. No. 3,825,431 (incorporated herein by reference. These are derivatives of block copolymers of ethylene oxide and/or 1,2-propylene oxide, which are etherfied with polyhydric alcohols and additionally esterified with carboxylic acids.

The thickened emulsion required for the print pastes can be produced, for example, by stirring the solid products, for example the thickener, into the aqueous phase of the emulsion, allowing them to swell and then emulsifying the solvent, which contains the emulsifiers to be added in accordance with the invention, in the said solution by stirring. However, an alternative procedure is to produce a fluid mixture of the thickener, the emulsifier to be added according to the invention and a little water, and use this mixture when producing the thickened emulsion.

Where appropriate, other oxyethylated alkylphenols or arylphenols can be added together with the emulsifiers to be added according to the invention.

In addition, the print pastes of the invention may also contain conventional thickeners, eg. alginates, starch ethers or carboxymethylcellulose.

The finished print paste is obtained in the conventional manner by stirring the thickened emulsion, which in addition to water and solvent contains the emulsifier to be added according to the invention, the thickener and the defoaming agent, if any, with the organic pigment or pigment preparation, one of the stated binders and, if appropriate, an additional water-soluble thickener and other print paste constituents conventionally used in practice. However, it is also possible to introduce part of the print paste constituents into the aqueous emulsifier solution before emulsifying the solvent. If a print paste has turned out too thin, thickener may also be added subsequently.

The print paste can be produced, for example, by first producing a thickened emulsion by mixing the emulsifier, an emulsion thickener, water and heavy gasoline, in which a defoaming agent, for example as described in U.S. Pat. No. 3,825,431, is dissolved, by vigorous stirring.

A finished pigment print paste for roller printing is then obtained, for example, by stirring 60 parts of an organic pigment preparation (containing 30% of pigment), 790 parts of the above thickened emulsion, 120 parts of a pigment binder, based on one of the above copolymers, in the form of a dispersion, and, where appropriate, from 10 to 40 parts of an aqueous solution of diammonium hydrogen phosphate, for example of 33.3% strength, as an acid donor.

Very level and bright prints are obtainable with the print pastes of the invention. The definition is excellent whether screen printing or roller printing is used. The print pastes are therefore particularly suitable for rotary screen printing. It is an advantage of the print pastes of the invention that only small amounts of the emulsion thickeners, such as are described, for example, in British Pat. No. 1,358,430, have to be used, the print pastes show little foaming even during manufacture, and even pastes of low viscosity have a good shelf life and are stable to shear. Surprisingly, the addition of defoaming agents does not affect the stability of the emulsion.

The print pastes on which the process of the invention are based can in the main be used for pigment prints on, for example, cotton, regenerated cellulose, wool, glass fiber fabrics and other natural and synthetic fibers, and a wide variety of mixed fabrics. However, it is also possible to produce the print pastes of the invention using, for example, conventional dyes, such as disperse dyes or reactive dyes.

In the Examples, parts and percentages are by weight.

EXAMPLE 1

145 parts of water are mixed, at room temperature, with 50 parts of a 7% strength aqueous solution of sodium alginate and 5 parts of the product obtained by reacting one mole of di-(α-phenylethyl)- phenol first with 3 moles of propylene oxide and then with 14 moles of ethylene oxide. 650 parts of gasoline, followed by 150 parts of a 40% strength aqueous dispersion of a copolymer of 70% by weight of ethyl acrylate and 30% by weight of styrene, are slowly added to the mixture, whilst stirring about 3,000 rpm. A very stable oil-in-water emulsion is obtained, to which organic pigments in the form of their commercial aqueous preparations are then added, in general in amounts of from 0.1 to 100 g per kg of print paste. The resulting pigment print pastes exhibit very high stability to shear and give bright prints, for example on a cotton fabric.

EXAMPLE 2

The following components are mixed: 150 parts of water, 10 parts of the reaction product obtained by reacting one mole of di-(α-phenylethyl)-phenol with 5 moles of propylene oxide and then with 15 moles of ethylene oxide, 100 parts of a 40% strength aqueous dispersion of a copolymer of 64 parts of N-butyl acrylate, 35 parts of styrene and 1 part of acrylic acid and 40 parts of a 25% strength solution of diammonium phosphate in water.

700 parts of gasoline are emulsified in this mixture by stirring at about 3000 rpm. An oil-in-water emulsion which withstands very high shear stresses is obtained. A further advantage is the stability of the oil-in-water emulsion to relatively high electrolyte contents. This property distinguishes the print paste particularly for use in discharge printing using organic pigments.

If 40 parts of a 30% strength commercial aqueous preparation of the organic pigment Color Index No. 71,105 are added to the mixture described above, bright prints are obtained, for example, on a 70:30 mixed fabric of polyester and regenerated cellulose.

EXAMPLE 3

5 parts of sodium polyacrylate (molecular weight about 200,000) are dissolved in 277 parts of water. 5 parts of the oxyalkylation product obtained by reacting 1 mole of di-(α-phenylethyl)-phenol first with 7 moles of propylene oxide and then with 20 moles of ethylene oxide, 10 parts of urea and 3 parts of diammonium phosphate are added to the solution. After a brief period, a homogeneous mixture is obtained, to which 500 parts of gasoline (boiling range 140° - 200° C) and 200 parts of a 40% strength aqueous dispersion of a copolymer of 65 parts of butyl acrylate, 24 parts of styrene, 6 parts of ethyl acrylate and 5 parts of N-methylolmethacrylamide are added, with vigorous stirring (3,000 rmp). A very stable oil-in-water emulsion is obtained, which is particularly suitable for use as a carrier for organic pigments.

If 25 parts of a 35% strength commercial aqueous preparation of the organic pigment Color Index No. 60,005 are added to the above mixture, a pigment print paste is obtained which exhibits no significant agglomeration of the pigment even in a very high shear gradient (produced by stirring the mixture at 6,000 rmp). Using the print paste described, it is possible, for example, to produce deep bright prints on regenerated cellulose.

COMPARATIVE EXAMPLE 1

Example 3 is repeated except that instead of the emulsifier to be employed according to the invention a reaction product obtained by oxyalkylating 1 mole of di-(α-phenylethyl)-phenol with a gas mixture containing 6.5 moles of propylene oxide and 18 moles of ethylene oxide is employed. Print pastes which exhibit pigment agglomeration even in a relatively low shear gradient and separate into a water phase and an oil phase on somewhat more severe treatment are obtained.

COMPARATIVE EXAMPLE 2

Example 3 is repeated, except that the emulsifier used is a reaction product which is manufactured by addition reaction of 16 moles of ethylene oxide with one mole of di-(α-phenyl-ethyl)-phenol, followed by reaction of the oxyethylation product with 5 moles of propylene oxide. If the print paste is exposed to intense shear, partial pigment agglomeration results, manifesting itself in a visible deterioration of the brightness and color yield of the prints. Furthermore, the print pastes are not stable on storage, and separate into an oil phase and a water phase.

EXAMPLE 4

Example 2 is repeated, except that the emulsifier employed is the oxyalkylation product which is obtained by reacting 1 mole of di-(α-phenylethyl)-phenol first with 5 moles of 1,2-butylene oxide and then with 17 moles of ethylene oxide. A print paste which is stable to shear and which gives bright deep prints is obtained.

We claim:

1. In a process for printing fibrous material, wherein a print paste consisting essentially of an oil-in-water emulsion of a pigment, a thickener, a pigment binder and an emulsifier of the type of the oxyalkylated phenol derivatives is applied to said fibrous material, the improvement which comprises using as the said emulsifier, from 0.1 to 0.5% by weight, based on the finished print paste, of a product obtained by first oxyalkylating one mole of di-(α-phenyl-ethyl)-phenol with from 2 to 12 moles of an epoxide selected from propylene oxide, butylene oxide and mixtures thereof, and then oxyethylating the product with from 14 to 30 moles of ethylene oxide whereby said emulsifiers can be poured or pumped at room temperature.

2. A process as claimed in claim 1, wherein the product added to the print paste is obtained by first oxypropylating one mole of di(α-phenylethyl)-phenol with from 3 to 9 moles of propylene oxide, and then oxyethylating the product with from 15 to 25 moles of ethylene oxide.

3. A process as claimed in claim 1, wherein the product added to the print paste is obtained by first oxybutylating one mole of di-(α-phenylethyl)-phenol with from 3 to 6 moles of butylene oxide, and then oxyethylating the product with from 15 to 25 moles of ethylene oxide.

4. Fibrous materials printed with a print paste comprising an oil-in-water emulsion of a pigment, a thickener, a pigment binder and, as the emulsifier, from 0.1 to 1.5% by weight of a product obtained by first oxyalkylating one mole of di-(α-phenylethyl)-phenol with from 2 to 12 moles of an epoxide selected from propylene oxide, butylene oxide and mixtures thereof and then oxyethylating the product with from 14 to 30 moles of ehtylene oxide.

* * * * *

UNITED STATES PATENT AND TRADEMARK OFFICE

CERTIFICATE OF CORRECTION

PATENT NO. : 4,064,309

DATED : December 20, 1977

INVENTOR(S) : Franz Merger et al

It is certified that error appears in the above-identified patent and that said Letters Patent are hereby corrected as shown below:

Column 6, line 5, "0.5%" should read --1.5%--.

Column 6, last line, "ehtylene" should read --ethylene--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*